United States Patent [19]

Boulva

[11] Patent Number: 4,500,297

[45] Date of Patent: Feb. 19, 1985

[54] PADDLE WHEEL PROPELLED WATERCRAFT

[76] Inventor: Paul Boulva, 221 Lockhart, T.M.R., Montreal, Que., Canada, H3P 1Y3

[21] Appl. No.: 429,309

[22] Filed: Sep. 30, 1982

[51] Int. Cl.[3] ..... B63H 16/00

[52] U.S. Cl. ..... 440/27; 440/90

[58] Field of Search ..... 440/21, 26, 27-32, 440/90, 91

[56] References Cited

U.S. PATENT DOCUMENTS

| | | | |
|---|---|---|---|
| 1,060,434 | 4/1913 | Demas | 440/31 |
| 3,045,636 | 7/1962 | Thomas et al. | 440/26 |
| 3,132,623 | 5/1964 | Conklin | 440/26 |
| 3,999,501 | 12/1976 | Duarte | 440/27 |
| 4,376,420 | 3/1983 | Fracarossi | 440/27 |

FOREIGN PATENT DOCUMENTS

| | | | |
|---|---|---|---|
| 2164255 | 6/1973 | Fed. Rep. of Germany | 440/27 |
| 959945 | 4/1950 | France | 440/32 |
| 2442758 | 8/1980 | France | 440/27 |
| 513742 | 2/1955 | Italy | 440/27 |

*Primary Examiner*—Trygve M. Blix
*Assistant Examiner*—Jesûs D. Sotelo
*Attorney, Agent, or Firm*—Oblon, Fisher, Spivak, McClelland & Maier

[57] ABSTRACT

A small watercraft comprised of a main floatation body having a seat portion. A pair of spaced apart side booms or a continuous U-shaped boom extend forwardly of the main floatation body one to each side of the main floatation body. An open area is defined between the side booms. A crank axle is retained transversely across the side booms over the open area. The crank axle has crank formations formed therein to impart axial rotation of opposed end portions of the axle. Water propelling means are secured to each opposed end portions of the axle to propel the floatation body on a water surface.

11 Claims, 12 Drawing Figures

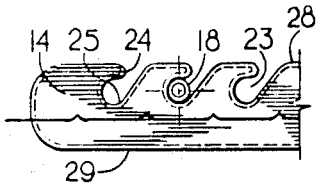
FIG. 3A
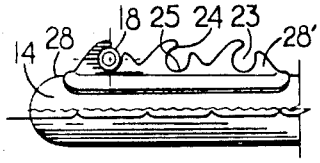
FIG. 3B
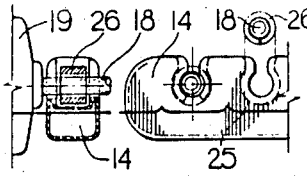
FIG. 3C
FIG. 3D
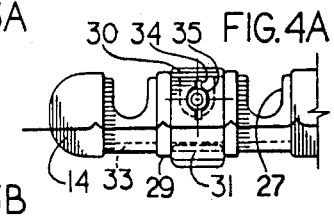
FIG. 4A
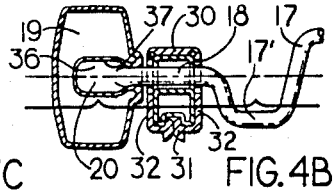
FIG. 4B
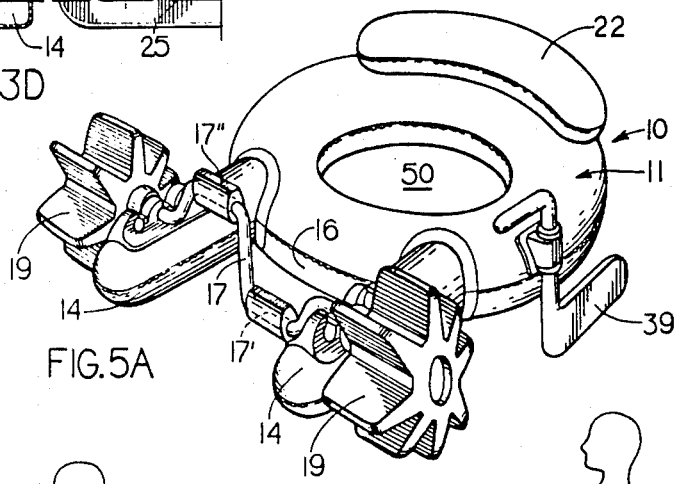
FIG. 5A
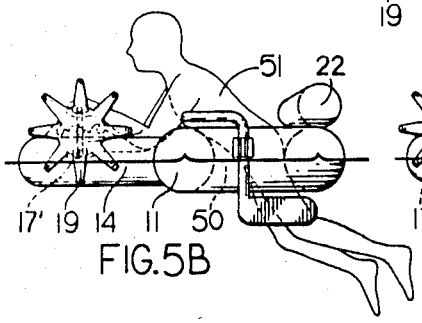
FIG. 5B
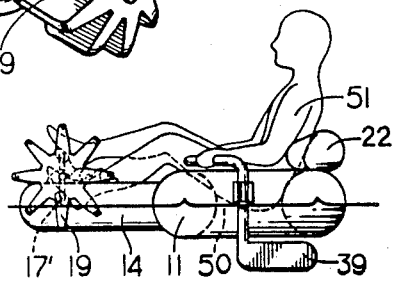
FIG. 5C

PADDLE WHEEL PROPELLED WATERCRAFT

BACKGROUND OF THE INVENTION (a) Field of Invention

The present invention relates to a small watercraft and more specifically to a pleasure watercraft to be used by a single person and wherein the propulsion thereof is effected by a crank axle operated by the user to cause operation of water displacement means.

(b) Description of Prior Art

Various types of watercrafts are known propelled by either the feet or hands and utilizing cranks to impart a rotational drive to water propelling means, such as one or more paddle wheels. Such type structures are, for example, described in U.S. Pat. No. 1,600,084 issued on Sept. 14, 1926; U.S. Pat. No. 2,998,798 issued Sept. 5, 1961; and U.S. Pat. No. 3,779,202 issued Dec. 18, 1973. These patents are selected to show various types of small watercraft propelled by paddle wheels as is the novel watercraft structure of the present invention.

SUMMARY OF INVENTION

The present invention relates to a small watercraft having a novel construction different from the structure heretofore known.

It is therefore a feature of the present invention to provide a small paddle wheel propelled watercraft for use by a single person.

Another feature of the present invention is to provide a small watercraft which is easy to transport, easy to operate, safe to use and very compact.

Another feature of the present invention is to provide a small watercraft which is constructed of solid floatation material and propelled by paddle wheels also constructed of rigid floatation material and wherein an open area is provided forwardly of a seat portion between side booms whereby to provide visibility to the user thereby making the watercraft very safe and pleasurable to use.

Another feature of the present invention is to provide a small watercraft with parts easy to assemble and that can easily be transported in a minimum space like the trunk of an automobile and which has a main floatation body which is inflatable while the propelling paddle wheels are of sealed vacuum formed rigid material to ensure constant security for the user due to the permanent floatation aspect of the paddle wheels which when solidely attached to the crank can be used independently by the user to propel himself with his hands.

Another feature of the present invention is to provide an adjustable crank axle to permit adaptation of the watercraft to young or grown-up persons whereby operation of the paddle wheels can be effected with comfort and ease.

According to the above features, from a broad aspect, the present invention provides a watercraft comprised of a floatation body having support means for a crank axle, said support means having at least two spaced apart side booms which extend forwardly of the main floatation body one to each side of the main floatation body. An open area is defined between the side booms. A crank axle is removably retained transversely across the side booms over the open area in axles retaining means. The crank axle has crank formations formed therein to impart axial rotation of opposed end portions. of the axle. A floatable paddle wheel is secured to each opposed end portions of the axle to propel the floatation body on a water surface. The paddle wheel is formed as a floatation body to add floatation support to the booms on the water surface. The crank axle and paddle wheels connected thereto, are detachable from the booms as a unitary structure to solely support a user on a water surface and to provide for the user to propel himself by hand operation of the crank formations to impart rotation to the wheels to generate a propelling force.

BRIEF DESCRIPTION OF DRAWINGS

A preferred embodiment of the present invention will now be described with reference to the examples thereof illustrated in the accompanying drawings, in which:

FIG. 3*a* is a cross-sectional view along cross-section line III—III of FIG. 2*b;*

FIG. 3*b* is a side view showing a different type of axle retaining means;

FIGS. 3*c* and 3*d* are a side elevation and a cross-section elevation, respectively, showing a still further type of axle retaining means;

FIG. 4*a* is a side view, partly in cross-section, showing a still further type of axle retaining means;

FIG. 4*b* is a front view, partly in section, showing the axle retaining means of FIG. 4*a* and its location with respect to a paddle wheel;

FIG. 5*a* is a perspective view illustrating another form of construction of the watercraft of the present invention;

FIG. 5*b* is a side view showing the watercraft of FIG. 5*a* when hand propelled and steered by the feet of the user; and FIG. 5*c* is a side view showing the watercraft of FIG. 5*a* when foot propelled.

DESCRIPTION OF PREFERRED EMBODIMENTS

Figure 1:
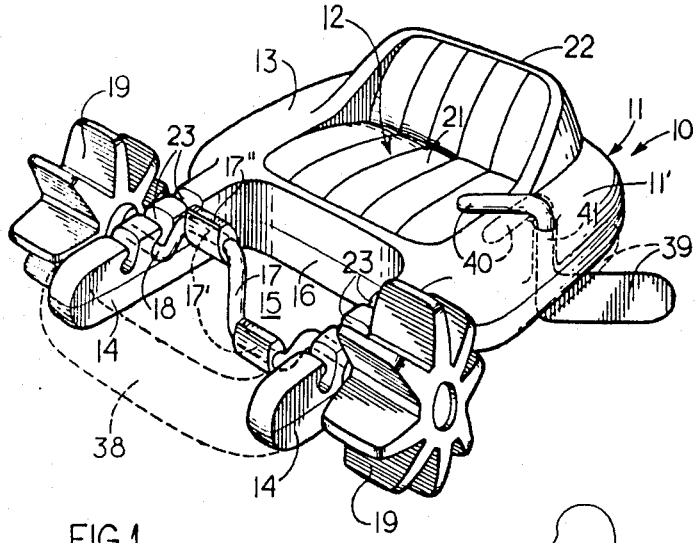
FIG. 1 is a perspective view of one form of construction of the watercraft of the present invention.
Figure 2A:
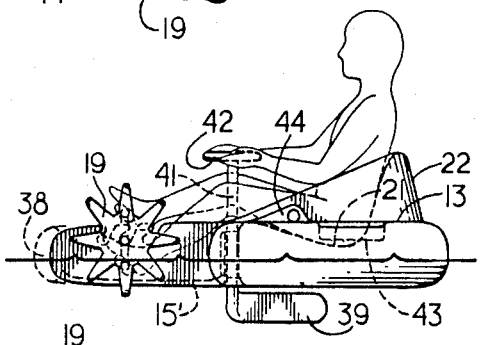
FIG. 2*a* is a side view showing the watercraft when foot propelled and illustrating further modifications thereof.
Figure 2B:
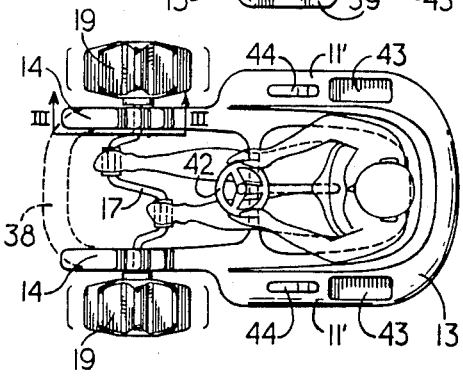
FIG. 2*b* is a top view of FIG. 2*a;*

Referring now to the drawings and more particularly to FIGS. 1, 2*a* and 2*b*, there is shown generally at 10 the foot propelled version of the watercraft of the present invention. The watercraft comprises a main floatation body 11 having a seat portion 12 formed on an upper side 13 thereof. A pair of spaced apart forward side booms 14 extend forwardly of the main floatation body 11 one to each side of the seat portion 12.

An open area 15 is defined between the side booms 14 and the front wall 16 of the main floatation body 11 whereby to provide visibility immediately in front of the seat portion 12 when the vehicle is used on a body of water. It can be seen that when the watercraft is used on water, the bottom of the body of water is visible to the user to prevent obstructing stones, dead trees or other such objects that may be damaging to the watercraft or cause injury to the user.

A crank axle 17 is retained transversely across the side booms 14 over the open area 15. The crank axle 17 is provided with crank formations 17' formed integrally therewith whereby to impart axial rotation of opposed straight end portion 18 of the axle. Water propelling means in the form of paddle wheels 19 are secured to each opposed free end 20 (see FIG. 4*b*) of the axle 17.

The formation 17′ may also be provided with foot pedals 17″ as shown in FIG. 1.

As shown more clearly in FIGS. 1 and 2*a*, the seat portion 12 is formed integral with the main floatation body 11 and has a seat cavity 21 extending substantially centrally and below the upper side 13 of the main floatation body. Thus, the main floatation body defines a circumferential floatation casing, as shown in FIG. 2*b*, about the seat cavity 21 for lateral floatation stability of the watercraft when operative on a water surface. The seat portion 12 is also provided with a backrest portion 22 formed integral with the main floatation body and extending upwardly behind the cavity 21 over a rear portion of the circumferential floatation casing.

The side booms 14 are each provided with axle retaining means which may be provided in various forms, and preferably but not exclusively, to provide the crank axle 17 to be detachably secured across the side booms to make the watercraft more compact to transport and to adapt it to persons of different leg length.

As shown in FIGS. 1, 2*a*, 2*b* and 3*a* the axle retaining means is constituted by two or more axle receiving transverse slots 23 extending transversely across the side booms 14 and each having a restrictive throat opening 24 leading to an axle receiving cavity 25 whereby to retain the straight end portion 18 of the crank axle 17 therein. As shown in FIG. 3*c* the straight opposed end portions 18 of the axle that fit into the transverse slots 23 may be provided with a bearing sleeve 26 which is in snap engagement in a respective one of the axle receiving cavities 25 whereby the axle is rotated within the sleeve. The sleeve may be constructed of wear resistant low friction material, such as a suitable plastics material. The sleeve 26 is retained in compression within the cavity 25.

As shown in FIGS. 4*a* and 4*b*, the axle retaining means may be constituted by at least two axle receiving slots 27 extending in and across the side booms 14 and having an open end in a top wall of the side arms. The open end could also be in the bottom wall 29 of the boom 14. This is also true of the slots 23 of the other versions of the axle retaining means. In fact, it is noted that if the slots are open in the bottom wall 29 of the booms, the upward pressure imparted on the axle 17 by the paddle wheels 19 floating on top of a water surface, maintains an upward pressure on the axle to keep it into the axle receiving cavity 25. However, with the embodiment of FIGS. 4*b* and 4*b* an axle retention flange 30, in the shape of a U-shaped flexible clamp made of hard plastic material, is provided to secure the straight end portion 18 of the axle in a fixed position across the slot 27. The clamp is provided with engagement ribs 31 at a free end of opposed side walls 32 thereof for engagement in a retention cavity 33 formed in the bottom wall of the side booms opposite each transverse slots 27.

The opposed side walls 32 of the flexible clamp 30 are provided with a vertical slot 34 having a circular opening 35 centrally thereof. The slot 34 permits passage of a flat plate-like coupling 36 provided at the opposed free ends 20 of the axle 17 whereby to secure the paddle wheel 19 to the axle. This end portion 36 is secured in close friction fit in a wheel cavity 37. Thus, the wheels 19 may be detached from the axle 17.

The above axle retaining means illustrated in FIGS. 3*a*, 3*c*, 4*a* and 4*b* are only examples of the various ways that the axle can be secured across the booms, when the booms are constructed of solid floatation material. For example, the main floatation body 11 with the side booms 14 and the paddle wheels 19 may be constructed of rigid vaccum formed thin plastic material for lightweight that could be even injected with foam material to obtain a solid floatation body that cannot sink when punctured.

In a further version of the watercraft of the present invention the main floatation body 11 and the side booms 14 are formed of a collapsible inflatable material such as rubber or canvas with solid vacuum formed plastic paddle wheels to ensure permanent security and floatability of the wheels to support the user on water in case of puncture of the main body or to help propel himself by hand to a safe location. In such a construction, the axle retaining means can be constituted by a rigid axle support member 28′, such as shown in FIG. 3*b*, which is secured on the top wall 28 of each side boom 14. Preferably the axle support member 28′ is molded from a plastics material and glued to the top wall 28.

As seen in FIGS. 1, 2*a* and 2*b*, a front boom 38 may be provided forwardly of the side booms 14 and formed integral therewith to constitute a wave breaker. This would provide for the surface of the water in the open area 15 to be calmer (less disturbed) than the surface of the water exteriorly of the watercraft to improve the visibility through the surface of the water. In addition, the open area 15 may be closed off at the bottom, intermediate the side booms 14, the front boom 38 and the front wall 16 of the main floatation body, with a bottom wall 15′ constructed of a flexible or solid membrane, such as a transparent plastics material.

In order to steer the watercraft on a body of water the hands of the user could be used or a rudder 39 could be provided. The rudder may be secured to a side portion 11′ of the main floatation body 11 forwardly thereof whereby a steering arm 40 connected to the rudder 39 through a control shaft 41 would be easily accessible to the user to steer the watercraft. As shown in FIGS. 2*a* and 2*b* the rudder may be constructed differently with the control shaft 41 being secured centrally and vertically over the front wall 16 of the main floatation body. Also, the steering arm 40 could be replaced by a steering wheel 42. As also shown in these Figures, tray cavities 43 may be molded in the side portions 11′ as well as attachment member 44 whereby to permit towing of the watercraft for securing same on the roof of a vehicle or for other suitable purpose.

As shown in FIGS. 5*a*–5*c* the seat portion 12 could be provided as a through bore 50 extending through the main floatation body 11. As shown in FIG. 5*b*, the user 51 would have the lower part of his body and legs extending through the bore 50 and the upper part thereabove. The crank formations 17′ would be operated by the hands of the user. The steering would be provided by the legs of the user. As shown in FIG. 5*c* the watercraft is also operable in the same manner as shown in FIGS. 2*a* and 2*b*.

It is within the ambit of the present invention to cover any obvious modifications of the preferred embodiment disclosed herein provided such modifications fall within the scope of the appended claims, for example, it is foreseen that each paddle wheel could be operated independently by a respective crank axle to effect steering by the paddle wheels. Thus, each axle would be supported independently in any manner well known to a person skilled in the art. Also, it is foreseen that the side booms be provided unattached to the main floatation body, for ease of storage, and be detachably securable to the main body prior to use.

I claim:

1. A watercraft comprising a main flotation body, said main flotation body having a seat portion, said seat portion being formed integral with said main flotation body and a seat cavity extending substantially centrally below an upper surface of said main flotation body, said main flotation body defining a circumferential flotation casing about said seat cavity for lateral flotation stability of said body, support means for a crank axle, said support means having at least two spaced apart side booms extending forwardly of said main flotation body one to each side of said main flotation body, a front boom bridging said side booms in a forward end thereof to constitute a wave breaking means, an open area defined between said side booms and said front boom, said open area being provided with a bottom wall spaced from said crank axle to permit crank formations in said axle to be freely displaced thereabove on an axle pivot axis, a crank axle removably retained transversely across said side booms over said open area in axle retaining means, said crank formations imparting axial rotation to opposed end portions of said axle, and a floatable paddle wheel secured to each opposed end portions of said axle to propel said flotation body on a water surface, said paddle wheel being formed as a flotation body to add flotation support to said booms on said water surface, said crank axle and paddle wheels connected thereto being detachable from said booms as a unitary structure to solely support a user on said water surface and to provide for the user to propel himself by hand operation of said crank formations to impart rotation to said wheels to generate a propelling force.

2. A watercraft as claimed in claim 1 wherein said seat portion has a backrest formed integral with said main floatation body and extends upwardly behind said cavity over a rear portion of said circumferential floatation casing.

3. A watercraft as claimed in claim 1 wherein said axle retaining means is constituted by at least two axle receiving transverse slots extending across said side booms, said slots each having a restrictive throat opening to retain a straight portion of said crank axle adjacent each end portion thereof in snap retention therein.

4. A watercraft as claimed in claim 3 wherein said straight portion of said crank axle adjacent opposed end portions is provided with a bearing sleeve for snap engagement in a respective one of transversely aligned ones of said slots in said side booms.

5. A watercraft as claimed in claim 3 wherein said axle retaining means is an axle support member secured on a top wall of each said side booms.

6. A watercraft as claimed in claim 1 wherein said main floatation body and side booms are molded integrally from a solid floatable material.

7. A watercraft as claimed in claim 1 wherein said main floatation body and side booms are made of an inflatable membrane.

8. A watercraft as claimed in claim 1 wherein said bottom wall is made of transparent material.

9. A watercraft as claimed in claim 1 wherein there is further provided a rudder to steer said watercraft, said rudder being secured to a side portion of said circumferential floatation casing, and a steering arm connected to a rudder control shaft to displace said rudder.

10. A watercraft as claimed in claim 1 wherein there is further provided a rudder to steer said watercraft, said rudder being secured centrally to a front portion of said circumferential floatation casing, and a wheel connected to a rudder control shaft to displace said rudder.

11. A watercraft as claimed in claim 1 wherein said seat portion is constituted by a through bore in said floatation casing dimensioned for the passage of a user's body therethrough.

* * * * *